US011743991B2

(12) United States Patent
Martinez Perez et al.

(10) Patent No.: US 11,743,991 B2
(45) Date of Patent: Aug. 29, 2023

(54) AUTOMOTIVE LIGHTING DEVICE AND METHOD

(71) Applicant: VALEO VISION, Bobigny (FR)

(72) Inventors: Jose Ramon Martinez Perez, Bobigny (FR); Jose Luis Lopez Leon, Bobigny (FR); Juan Jose Santaella Hernandez, Bobigny (FR)

(73) Assignee: Valeo Vision, Bobigny (FR)

( * ) Notice: Subject to any disclaimer, the term of this patent is extended or adjusted under 35 U.S.C. 154(b) by 95 days.

(21) Appl. No.: 17/425,399

(22) PCT Filed: Jan. 30, 2020

(86) PCT No.: PCT/EP2020/052365
§ 371 (c)(1),
(2) Date: Jul. 26, 2021

(87) PCT Pub. No.: WO2020/157243
PCT Pub. Date: Aug. 6, 2020

(65) Prior Publication Data

US 2022/0104327 A1 Mar. 31, 2022

(30) Foreign Application Priority Data

Jan. 31, 2019 (EP) ..... 19382064

(51) Int. Cl.
*H05B 45/395* (2020.01)
*H05B 45/40* (2020.01)
(Continued)

(52) U.S. Cl.
CPC ..... *H05B 45/56* (2020.01); *H05B 45/3725* (2020.01); *H05B 45/395* (2020.01)

(58) Field of Classification Search
CPC ..... H05B 45/00; H05B 45/18; H05B 45/40; H05B 45/3725; H05B 45/395; H05B 45/46; H05B 45/52; H05B 45/56
See application file for complete search history.

(56) References Cited

U.S. PATENT DOCUMENTS 6,351,079 B1 2/2002 Willis
2004/0217712 A1 11/2004 Takeda et al.
(Continued)

OTHER PUBLICATIONS

European Patent Office, International Search Report and Written Opinion of corresponding International Application No. PCT/EP2020/052365, dated Mar. 17, 2020.

*Primary Examiner* — Thai Pham
(74) *Attorney, Agent, or Firm* — Valeo Vision

(57) ABSTRACT

The invention provides an automotive lighting device for an automotive vehicle. This device comprises a voltage regulator, a temperature sensor and a controlled light group. The controlled light group comprises a plurality of light sources and a light driver, the light driver comprising terminals and being configured to selectively activate or deactivate current flow in each terminal, in such a way that each light source is connected to one of the terminals. The controlled light group is fed by a voltage output value of the voltage regulator, the temperature sensor is arranged to sense a temperature in a zone of the lighting device and send information to the voltage regulator and the voltage regulator comprises a control driver to modify the voltage output value when receiving information from the temperature sensor.

13 Claims, 2 Drawing Sheets

(51) Int. Cl.
*H05B 45/56* (2020.01)
*H05B 45/3725* (2020.01)

(56) References Cited

U.S. PATENT DOCUMENTS

| | | | | |
|---|---|---|---|---|
| 2008/0272651 | A1* | 11/2008 | Fong | H05B 45/46 307/31 |
| 2010/0013411 | A1* | 1/2010 | Krespach | H05B 45/38 315/294 |
| 2011/0084620 | A1* | 4/2011 | Lee | H05B 45/38 315/186 |
| 2013/0169152 | A1* | 7/2013 | Ishii | H05B 47/10 315/77 |
| 2014/0103813 | A1* | 4/2014 | Moss | H05B 45/385 315/297 |
| 2016/0242254 | A1* | 8/2016 | Baccarin | B60Q 1/0094 |
| 2018/0014376 | A1 | 1/2018 | Park et al. | |
| 2018/0146523 | A1 | 5/2018 | Nakatani et al. | |

* cited by examiner

AUTOMOTIVE LIGHTING DEVICE AND METHOD

CROSS-REFERENCE TO RELATED APPLICATIONS

This is a 371 application (submitted under 35 U.S.C. § 371) of International Application No. PCT/EP2020/052365 (WO202/0157243) filed on Jan. 30, 2020, which claims the priority date benefit of European Application No. EP19382064.4 filed on Jan. 31, 2019, the disclosures of which are hereby incorporated by reference in their entirety.

TECHNICAL FIELD

This invention is related to the field of automotive lighting devices which are controlled to provide complex lighting functionalities.

BACKGROUND

Automotive lighting devices are designed to perform different functionalities. To do so, the lighting device comprises different lighting modules, each of them being in charge of one of the lighting functionality.

Current lighting functionalities are requested to provide a high resolution response, to perform animations or any other lighting feature. A huge amount of small light sources, such as LEDs, are usually employ to achieve this aim.

This increasing amount of light sources makes the lighting devices manufacturers employ a more sophisticated control devices. However, these drivers may have some temperature requirements, in order to maintain a proper performance.

An input voltage stabilization circuit can set a maximum voltage for the operation of the light sources. This is a good way of limiting the heat dissipated by the driver but has some drawbacks in term of the voltage which is provided to said light sources, since the correct operation of the light sources depends on the voltage provided to them.

A solution for this problem is therefore sought.

SUMMARY

The invention provides a solution for the heat dissipation in the driver by means of an automotive lighting device according to claim 1 and a method according to claim 11. Preferred embodiments of the invention are defined in dependent claims.

Unless otherwise defined, all terms (including technical and scientific terms) used herein are to be interpreted as is customary in the art. It will be further understood that terms in common usage should also be interpreted as is customary in the relevant art and not in an idealised or overly formal sense unless expressly so defined herein.

In this text, the term "comprises" and its derivations (such as "comprising", etc.) should not be understood in an excluding sense, that is, these terms should not be interpreted as excluding the possibility that what is described and defined may include further elements, steps, etc.

In a first inventive aspect, the invention provides an automotive lighting device for an automotive vehicle, the automotive lighting device comprising a voltage regulator configured to be electrically fed between a power source and a ground connection. The automatic lighting device can further comprise a temperature sensor. The automatic lighting device can additionally comprise a controlled light group, with the controlled light group comprising a plurality of light sources and a light driver, the light driver comprising terminals and being configured to selectively activate or deactivate current flow in each terminal, in such a way that each light source is connected to one of the terminals, wherein the controlled light group is fed by a voltage output value of the voltage regulator, wherein the temperature sensor is arranged to sense a temperature in a zone of the lighting device and send information to the voltage regulator, and wherein the voltage regulator comprises a control driver to modify the voltage output value when receiving information from the temperature sensor.

In this lighting device, the voltage regulator does not establish a maximum value for all the elements of the lighting device, but establishes a voltage output value which is optimum for each temperature value sensed by the temperature sensor. As a consequence, the LEDs receive a suitable voltage value, which depends on their temperature, and the driver receives the remainder of the voltage output value. This remainder has been calculated by the voltage regulator, reducing its value when the temperature rises, since a temperature increase causes a voltage decrease in the light sources. Hence, this remainder is kept between the safety range so that the driver may perform without heating problems.

In some particular embodiments, the light driver is located in series with the light sources with respect to the voltage regulator, in such a way that the light driver is arranged between the voltage regulator and the light sources.

This arrangement is a current source arrangement, where the driver receives the current from the voltage regulator and then feeds the light sources.

In some particular embodiments, the light driver is located in series with the light sources with respect to the voltage regulator, in such a way that the light sources are arranged between the voltage regulator and the light driver.

This arrangement is a current sink arrangement, where the driver receives the current from the voltage regulator and then feeds the light sources.

In some particular embodiments, the light driver is a multi-channel driver.

This multi-channel driver is useful when there is a high amount of light sources which need to be controlled.

In some particular embodiments, the voltage regulator is a linear regulator. In different embodiments, the voltage regulator is a switched regulator. These types of voltage regulators provide an accurate control of the voltage amount, following the instructions received from the control driver, which calculates the ideal temperature which provides a suitable voltage output value for the light driver and the light sources.

In some particular embodiments, the temperature sensor is a thermistor, such as a NTC or a PTC.

A thermistor is a simple and effective option to sense the temperature around the light sources. NTC and PTC are different possibilities which provide data reliable enough.

In some particular embodiments, the light sources are configured to perform more than one different lighting functionality. In some particular embodiments, the functionalities are daily running light and position light, stop light and tail light or turning indicator.

In some particular embodiments, the light sources are solid-state light sources, such as LEDs.

The term "solid state" refers to light emitted by solid-state electroluminescence, which uses semiconductors to convert electricity into light. Compared to incandescent lighting, solid state lighting creates visible light with reduced heat generation and less energy dissipation. The typically small mass of a solid-state electronic lighting device provides for greater resistance to shock and vibration compared to brittle glass tubes/bulbs and long, thin filament wires. They also eliminate filament evaporation, potentially increasing the life span of the illumination device. Some examples of these types of lighting comprise semiconductor light-emitting diodes (LEDs), organic light-emitting diodes (OLED), or polymer light-emitting diodes (PLED) as sources of illumination rather than electrical filaments, plasma or gas.

In a further inventive aspect, the invention provides a method for controlling an automotive lighting device according to the first inventive aspect, the method comprising the steps of sensing temperature in a zone of the automotive lighting device, and modifying the voltage output value of the voltage regulator.

With this control method, the light driver is always working with an input voltage value which is harmless in terms of heat dissipation.

In some particular embodiments, the temperature is sensed around the light sources. This measurement provides more accurate data of the temperature state of the light sources. In other embodiments, the temperature is sensed in other zones, and the control driver correlates the data, estimating the temperature of the light sources.

In some particular embodiments, the control driver modifies the voltage output value of the voltage regulator to keep a predetermined voltage value in the light driver.

This method allows setting the operation of the light driver at a constant value which optimizes its operation.

BRIEF DESCRIPTION OF THE DRAWINGS

To complete the description and in order to provide for a better understanding of the invention, a set of drawings is provided. Said drawings form an integral part of the description and illustrate an embodiment of the invention, which should not be interpreted as restricting the scope of the invention, but just as an example of how the invention can be carried out. The drawings comprise the following figures.

Elements of the example embodiments are consistently denoted by the same reference numerals throughout the drawings and detailed description where appropriate.

Figure 1:
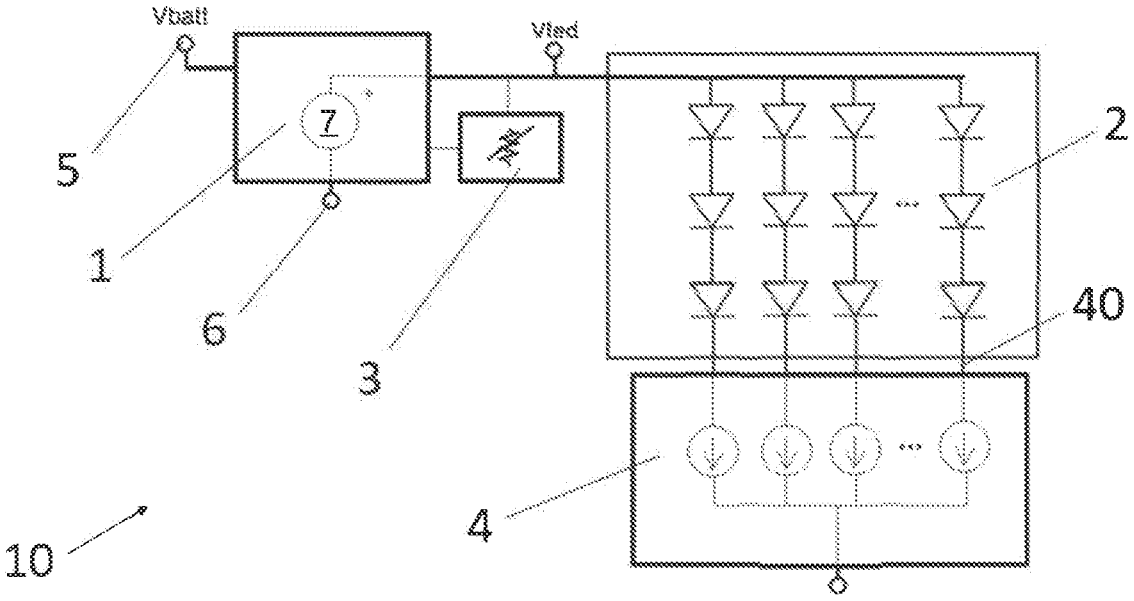
FIG. 1 shows a general electric scheme of an automotive lighting device according to the invention.

1 Voltage regulator
2 Light sources
3 Temperature sensor
4 Light driver
5 Power source
6 Ground connection
10 Automotive lighting device
40 Light driver terminals
100 Automotive vehicle

DETAILED DESCRIPTION OF THE INVENTION

The example embodiments are described in sufficient detail to enable those of ordinary skill in the art to embody and implement the systems and processes herein described. It is important to understand that embodiments can be provided in many alternate forms and should not be construed as limited to the examples set forth herein.

Accordingly, while embodiment can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

FIG. 1 shows a general electric scheme of an automotive lighting device 10 according to the invention. This automotive lighting device 10 comprises a voltage regulator 1 configured to be electrically fed between a power source 5 and a ground connection 6, a temperature sensor 3, and a controlled light group, comprising a group of LEDs 2 and a light driver 4.

The light driver 4 comprises terminals 40 and is configured to selectively activate or deactivate current flow in each terminal 40, in such a way that each LED 2 is connected to one of the terminals 40.

In the embodiment shown in this figure, the light driver 4 is arranged in series with the LEDs 2 with respect to the voltage regulator 1, in such a way that the light driver 4 is arranged between the voltage regulator 1 and the LEDs 2.

The main aim of the voltage regulator 1 is setting the correct voltage output value to feed the controlled light group, since light drivers 4 usually have power restrictions, due to the heat dissipation which may lead to overheating.

The group of LEDs 2 consume a portion of the voltage output value set by the voltage regulator 1. This consumption depends on the working temperature. The temperature sensor 3 is arranged to sense the temperature around the LEDs 2 and hence calculate the LED voltage value, which is consumed by the LEDs 2. The light driver 4 needs a constant driver voltage value. As a consequence, the control driver 7 of the voltage regulator 1 receives the information about the temperature of the LEDs 2 provided by the temperature sensor 3, which is useful to calculate the LED voltage value. Since the driver voltage value is constant, the control driver 7 provides the voltage regulator 1 with a voltage value which is suitable so that the LEDs 2 are working properly and the light driver 4 does not overheat.

The light driver 4 is a multi-channel driver, to be able to control the whole amount of LEDs 2 which are intended to provide the lighting functionalities.

This device 10 may be embodied with a voltage regulator 1 with linear technology or with a voltage regulator 1 with switched technology.

Figure 2:
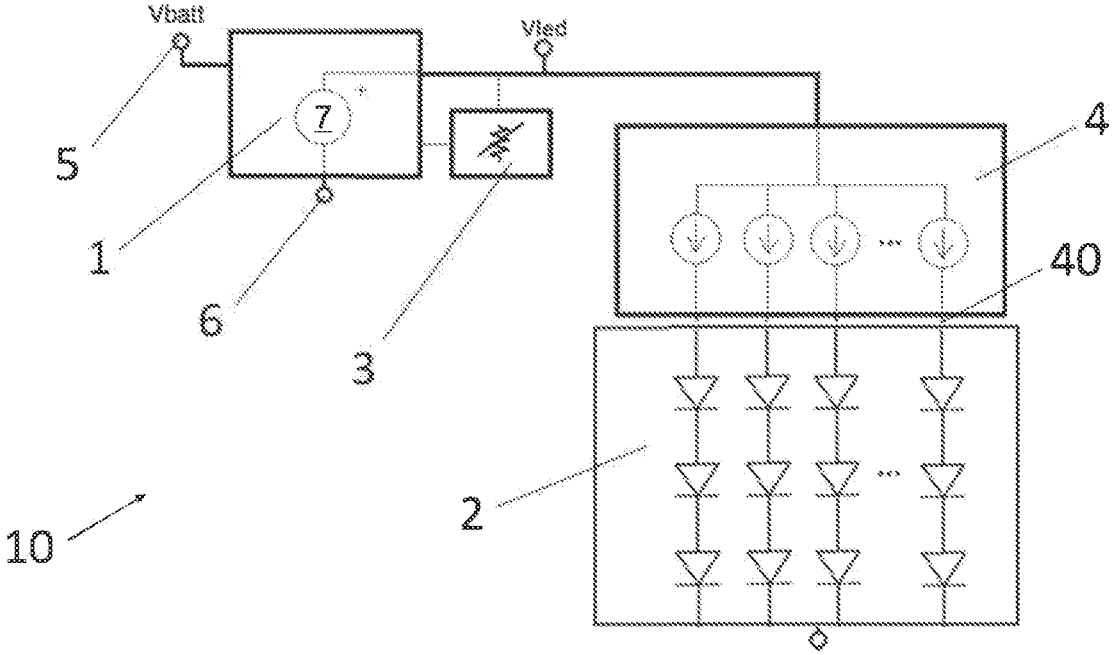
FIG. 2 show a scheme alternative of another automotive lighting device according to the invention.

FIG. 2 shows a scheme alternative of a different automotive lighting device according to the invention.

In the embodiment of FIG. 1, the light driver 4 was arranged in series with the light sources 2 with respect to the voltage regulator 1, in such a way that the light driver 4 is arranged between the voltage regulator 1 and the light sources 2.

In this embodiment of FIG. 2, the light driver 4 is arranged in series with the light sources 2 with respect to the voltage regulator 1, in such a way that the light sources 2 are arranged between the voltage regulator 1 and the light driver 4.

Figure 3:
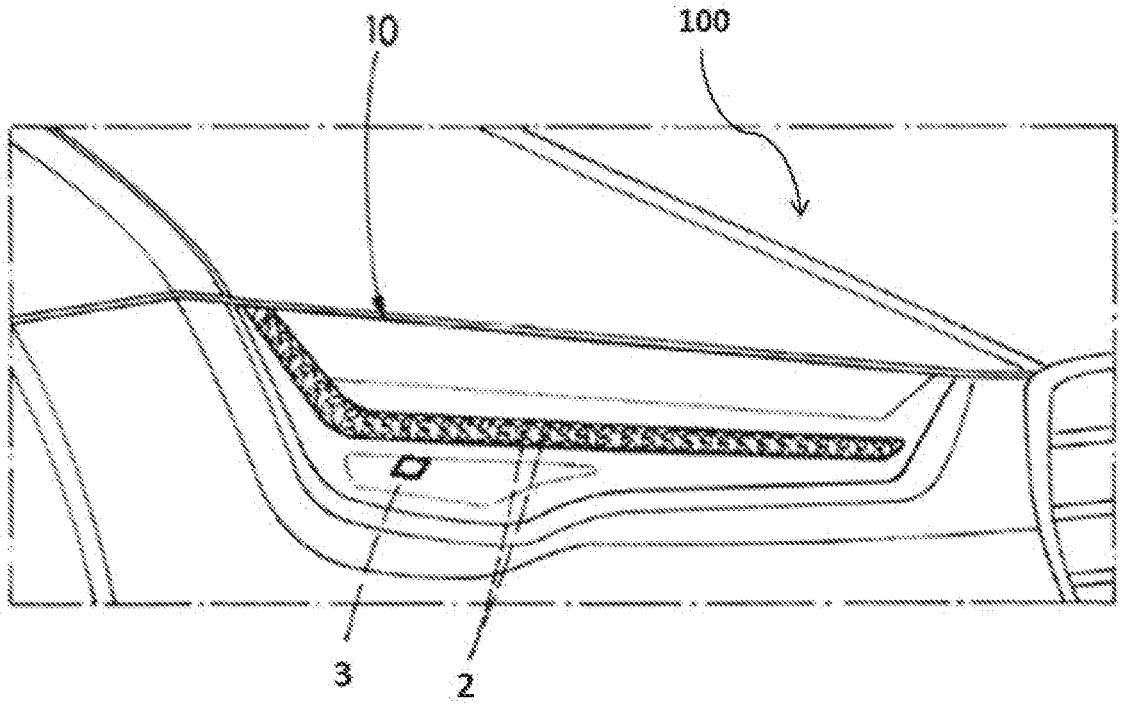
FIG. 3 shows an automotive lighting device according to the invention installed in an automotive vehicle.

FIG. 3 shows an automotive lighting device 10 according to the invention installed in an automotive vehicle 100.

This automotive lighting device 10 controls the operation of a great amount of LEDs 2 without an overheating risk for the internal light driver. As a consequence, the performance of the LEDs 2 may be optimized without endangering the operation of the rest of the device.

The sensor 3 is located near the LEDs 2 to sense accurate data about the LEDs' temperature.

What is claimed is:

1. An automotive lighting device for an automotive vehicle, the automotive lighting device comprising:

a temperature sensor arranged to sense and communicate temperature information in a zone of the automotive lighting device;

a voltage regulator configured to be electrically fed between a power source and a ground connection in communication with the temperature sensor, the voltage regulator includes a control driver configured to modify the voltage output value responsive to the temperature information; and a controlled light group fed by a voltage output value of the voltage regulator, the control light group includes a plurality of light sources and a light driver, the light driver having a plurality of terminals and being configured to selectively activate or deactivate current flow in each terminal, in such a way that each of the plurality of light sources is connected to one of the terminals, with the voltage regulator, the plurality of lights, and the light driver arranged in series.

2. The automotive lighting device according to claim 1, wherein the light driver is located in series with the light sources with respect to the voltage regulator, in such a way that the light driver is arranged between the voltage regulator and the light sources.

3. The automotive lighting device according to claim 1, wherein the light driver is located in series with the light sources with respect to the voltage regulator, in such a way that the light sources are arranged between the voltage regulator and the light driver.

4. The automotive lighting device according to claim 1, wherein the light driver is a multi-channel driver.

5. The automotive lighting device according to claim 1, wherein the voltage regulator is a linear regulator.

6. The automotive lighting device according to claim 1, wherein the voltage regulator is a switched regulator.

7. The automotive lighting device according to claim 1, wherein the temperature sensor is a thermistor.

8. The automotive lighting device according to claim 1, wherein the light sources are configured to perform more than one different lighting functionality.

9. The automotive lighting device according to claim 8, wherein the more than on different functionalities are selected from the group consisting of daily running light, position light, stop light, tail light, and turning indicator.

10. The automotive lighting device according to claim 1, wherein the light sources are solid-state light sources.

11. A method for controlling an automotive lighting device, comprising:

switching, with a lighting driver, an on/off state for some of a plurality of light sources in the automotive lighting device;

sensing, with a temperature sensor, a temperature in a zone of in the automotive lighting device;

modifying a voltage output value of a voltage regulator, with a control driver, in the automotive lighting device responsive to the temperature, with the voltage regulator, the plurality of light sources, and the light driver arranged in series.

12. The method according to claim 11, wherein the temperature is sensed around light sources.

13. The method according to claim 12, wherein modifying the voltage output value includes controlling the voltage regulator, with the control driver, to modify the voltage output value to keep a predetermined value in a light driver.

* * * * *